United States Patent [19]

Noll et al.

[11] 4,330,029

[45] May 18, 1982

[54] MOUNTING DEVICE FOR HEAT RECOVERY WHEELS

[75] Inventors: Burton A. Noll, Painted Post; Richard P. Suhey, Horseheads, both of N.Y.

[73] Assignee: Corning Glass Works, Corning, N.Y.

[21] Appl. No.: 205,779

[22] Filed: Nov. 10, 1980

[51] Int. Cl.[3] ..... F28D 19/00

[52] U.S. Cl. ..... 165/8; 464/41; 464/97

[58] Field of Search ..... 165/8, 10; 64/29, 30 R, 64/30 E, 27 C, 1 S, 27 CS, 27 S, 23.5

[56] References Cited

U.S. PATENT DOCUMENTS

| | | | |
|---|---|---|---|
| 996,384 | 6/1911 | Wiard | 64/30 E |
| 1,482,402 | 2/1924 | Lamb | 64/30 EX |
| 3,296,829 | 1/1967 | Williams | 165/8 X |
| 3,612,163 | 10/1971 | Powell | 165/8 |
| 3,774,675 | 11/1973 | Yoshiro | 165/8 |
| 3,850,228 | 11/1974 | Barnard | 165/8 |
| 4,058,157 | 11/1977 | Wiegard | 165/8 |

FOREIGN PATENT DOCUMENTS

| | | | |
|---|---|---|---|
| 2407442 | 8/1975 | Fed. Rep. of Germany | 165/8 |

*Primary Examiner*—Albert W. Davis
*Attorney, Agent, or Firm*—Richard N. Wardell

[57] ABSTRACT

Disclosed is a novel mounting structure for a rotatable heat exchanger, sometimes known as a heat recovery wheel. The mounting structure includes a hub portion on at least one side of the wheel and axially aligned therewith with at least three radially movable shoes situated within the bore of the wheel and coupled to the hub portion. A torsion bar is connected to the hub which applies equal radial forces to each of the shoes whereby the shoes are biased against the wheel at the periphery of the bore and equally displaced from the axis of the wheel. The aforementioned arrangement provides a mounting which is self centering and yet which permits differential radial expansion of a metal hub with respect to a ceramic wheel.

12 Claims, 4 Drawing Figures

MOUNTING DEVICE FOR HEAT RECOVERY WHEELS

BACKGROUND OF THE INVENTION

The present invention relates in general to rotatable heat exchangers, sometimes known as heat recovery wheels, and, in particular, it relates to a novel mounting structure for such heat recovery wheels.

In gas turbines, furnaces, and other combustion chambers it is desirable to preheat incoming combustion gases with heat extracted from exhaust gases, thereby increasing combustion efficiency. Rotary heat exchangers or heat recovery wheels are particularly desirable for this purpose. Heat recovery wheels are generally mounted for rotation about a central axis. The wheel first rotates through the exhaust gas stream. The wheel has apertures extending therethrough in the axial direction. Gases flow axially through the apertures and heat is extracted from the exhaust gas stream and absorbed by the wheel. As the wheel further rotates through the incoming gas stream, this heat is given up by the wheel to the incoming gas.

Most conventionally, heat recovery wheels are centrally supported and driven by a torque applied to the hub thereof. However, it is also known to drive such wheels from the periphery. In either case, it is particularly important that the rotational stability of the wheel be maintained, i.e. it is important that the wheel remain centered about its axis of rotation as the temperatures to which it is subjected vary. When the axis of rotation varies, forces exerted upon the wheel may cause its breakage. Also, in the case of peripherally driven wheels, the wheel when rotating eccentrically may lose contact with its driving means.

While heat recovery wheels may be made from metal, ceramic materials are preferred because ceramic materials can have a low coefficient of thermal expansion and a high resistance to oxidation and corrosion. However, even though ceramics are chosen for the body of such wheels, metals are still employed for the driver hub. Since the coefficient of expansion of the metal hub differs from the coefficient of expansion of the ceramic, it is generally necessary to securely mount the wheel to its hub while permitting differential thermal expansion of the hub in the radial direction with respect to the wheel. U.S. Pat. No. 3,774,675—Yoshiro discloses such a mounting arrangement. In the Yoshiro patent, pads are provided which are radially expandable within the bore of a ceramic heat recovery wheel. A plurality of spring means are provided which bias the pads radially outwardly. One problem associated with the aforementioned Yoshiro design is that with that approach, since a plurality of spring means are employed, it is impossible to select springs having exactly equal spring constants. Since the springs have varying spring constants, the heat recovery wheel of Yoshiro is very difficult to center about its axis of rotation.

It would be desirable to provide a mounting device for a ceramic heat recovery wheel which is self-centering. It is an object of the present invention to provide a mounting device for a heat recovery wheel which is self-centering. It is a further object of the present invention to provide a mounting device which is self-centering and yet which permits the differential radial expansion of a metal hub with a ceramic wheel.

SUMMARY OF THE INVENTION

The aforementioned and other objects of the present invention are achieved by the provision of a mounting device for a heat recovery wheel having a central bore therein. A first and second hub portion are situated on opposite sides of the wheel ajacent the bore and axially aligned therewith. The first and second hub portions clamp the wheel therebetween, preferably with a resilient fastening means. Situated within the bore of the wheel are at least three radially movable shoes equiangularly spaced about the bore. Cam-driven means are provided for applying equal raidal forces to the shoes whereby the shoes are biased against the wheel at the periphery of the bore and equally displaced from the axis of the wheel. Such means include a torsion bar connected to the first hub. The torsion bar cooperates with at least three cams driven by the torsion bar. The torsion bar urges the cams radially outwardly as the wheel rotates, and cam followers connected to the shoes and driven by the cams bias the shoes outwardly and into abutting relationship with the main body of the ceramic wheel.

In one embodiment, the mounting device further includes a plurality of auxiliary shoes in addition to those shoes driven by the aforementioned torsion bar which are also spaced equiangularly about the periphery of the bore. Spring means are associated with each of the auxiliary shoes for biasing them radially outwardly against the wheel so as to maintain the hub and wheel in abutting relationship whether or not torque is applied to the aforementioned torsion bar.

RELATED APPLICATION

Ser. No. 205,780 filed Dec. 10, 1980 by the present applicants, which is assigned to the assignee of the present application, discloses an alternative mounting arrangement for ceramic heat recovery wheels of which the present application is an improvement.

BRIEF DESCRIPTION OF THE DRAWING

These and other objects of the present invention will be more fully understood by reference to the accompanying drawings in which.

DETAILED DESCRIPTION OF THE PREFERRED EMBODIMENT

Figure 1:
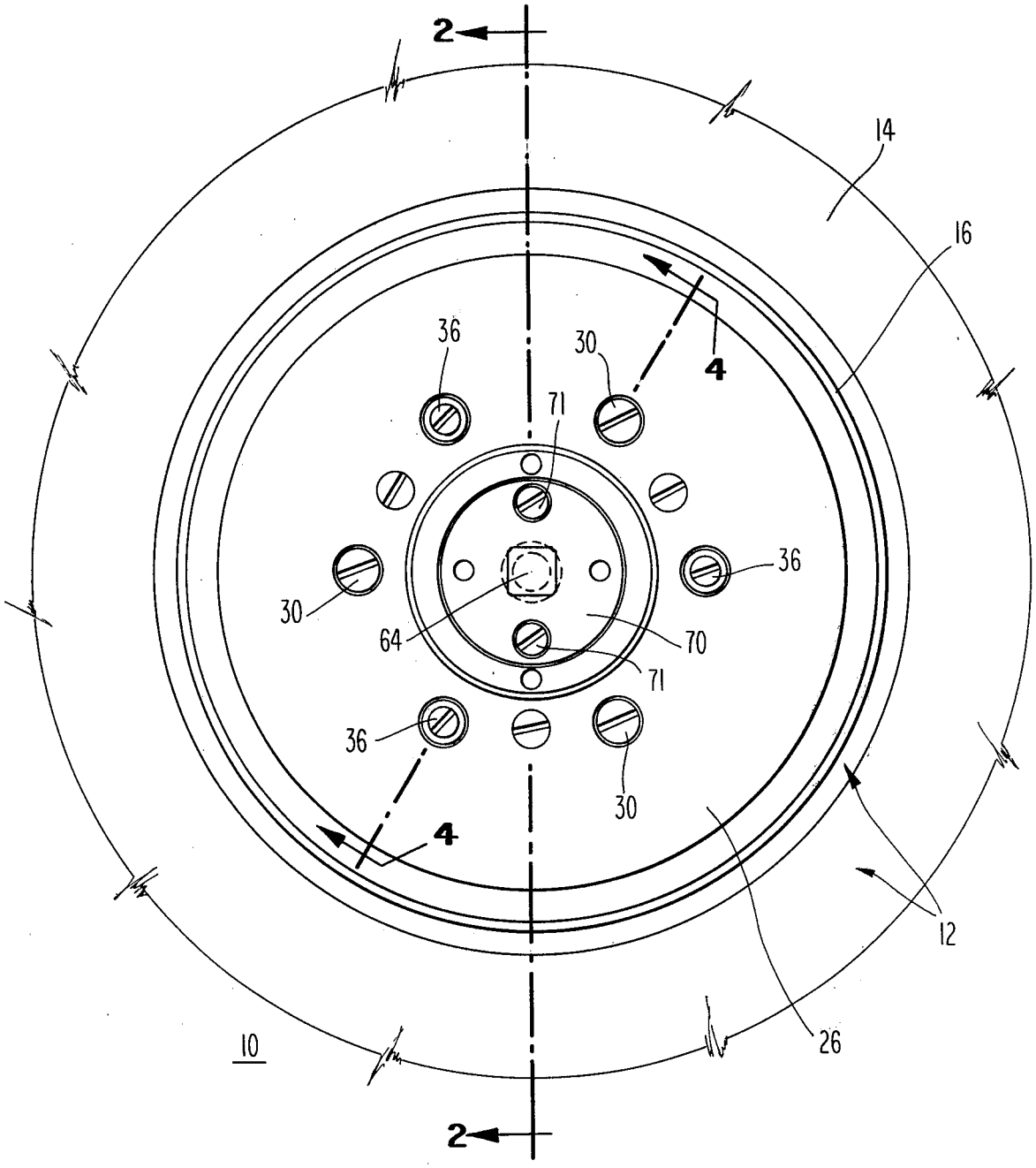
FIG. 1 is a plan view of a rotatable heat recovery wheel employing the novel hub means of the present invention.

FIG. 1 shows a rotatable heat recovery wheel generally at 10. The wheel 10 includes a round ceramic disk shown generally at 12. The ceramic disk 12 contains an apertured portion 14 and a non-apertured portion or wheel hub 16. The apertured portion contains a plurality of apertures, (not shown) the longitudinal axes of which extend parallel to the axis of the wheel 10. A catalytically active substance can be deposited on interior walls of the aforementioned apertures. In the preferred embodiment, the apertured portion 14 of the ceramic disk 12 is made according to the teachings of U.S. Pat. No. 3,790,654, usually as segments which are later cemented together.

Figure 2:
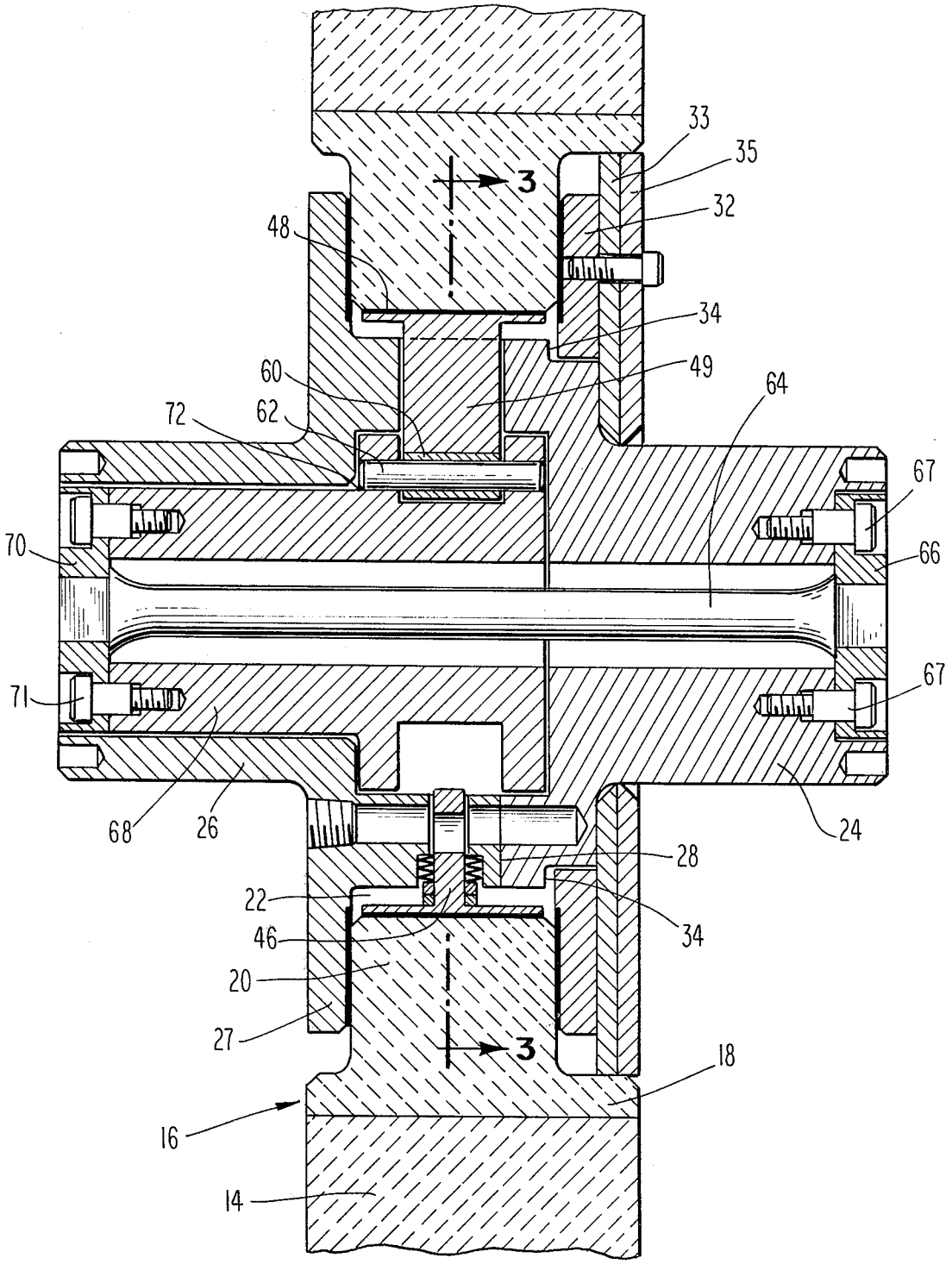
FIG. 2 is a cross-sectional view taken along lines 2—2 of FIG. 1.

As may best be seen from FIG. 2, the non-apertured portion 16 of the ceramic disk 12 is comprised of a peripheral portion 18 having an axial dimension equal to that of the aperture portion 14 and a central shoulder portion 20 having a lesser axial dimension. The ceramic disk 12 includes a central bore 22 therein. Situated on the opposite sides of the central bore 22 and axially aligned with the heat recovery wheel 10 is a metal driver hub having a first hub portion 24 and a second hub portion 26.

Figure 4:
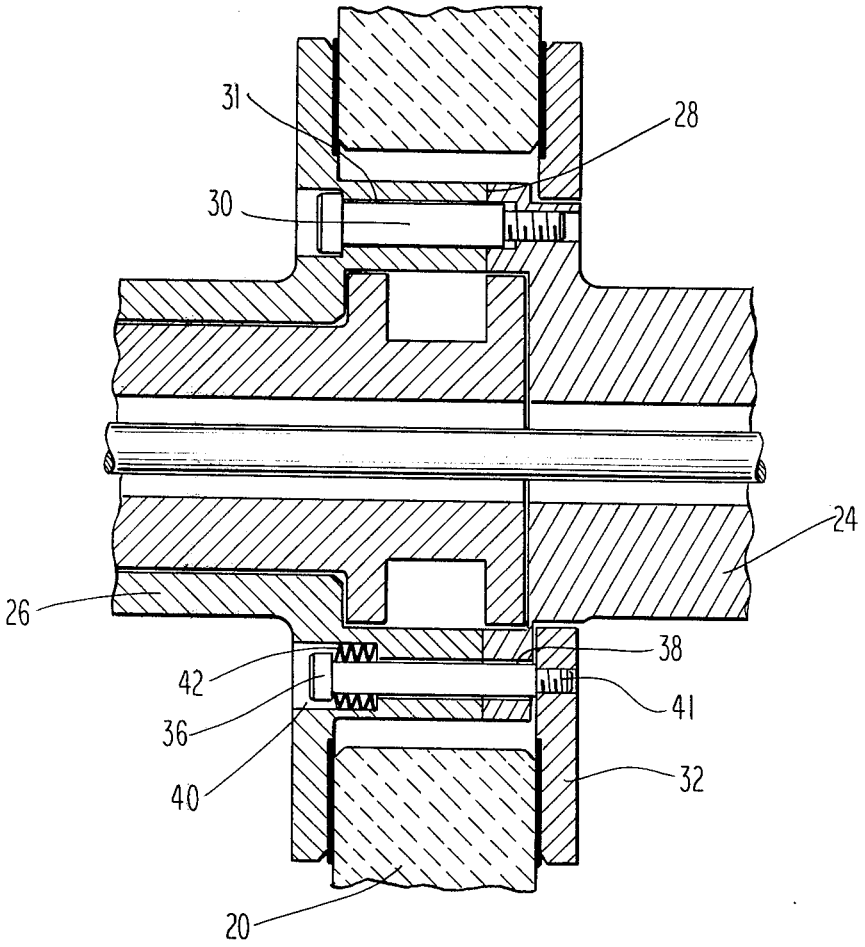
FIG. 4 is a cross-sectional view taken along lines 4—4 of FIG. 1.

The first hub portion 24 and the second hub portion 26 are joined to each other at an interface 28 within the bore 22. The first and second hub portion 24 and 26 are retained in abutting relationship to one another by means of bolts 30 in holes 31. Moreover, the first hub portion 24 and second hub portion 26 are retained in abutting relationship with respect to the ceramic disk 12 by means of a retainer plate 32. The retainer plate 32 is an annular member which abuts the central shoulder portion 20 of the ceramic disk 12 and also against a peripheral shoulder portion 34 of the first hub portion 24. The second hub portion 26 has a flange 27 which also abuts the shoulder portion 20 of the disk 12 so as to clamp the disk between the hub portions 24 and 26. Protecting the retainer plate 32 and the non-apertured portion 16 of the ceramic disk 12 are two layers of heat insulation 33 and 35 which are annular shaped. The first hub portion 24 is situated in the center thereof as shown. As may best be seen in FIG. 4, the retainer plate 32 is held in position with respect to the flange 27 and the shoulder portion 20 of the ceramic disk 12 by means of bolts 36 which pass through aligned apertures 38 and 40 in the first and second hub portions 24 and 26 respectively. The ends 41 of the bolts 36 threadedly engage plate 32. To allow for differential thermal expansion in the axial direction of the rotatable heat recovery wheel 10, belleville springs 42 are provided which abut the heads of bolts 36 and also against the second hub portion 26 so as to permit movement of the second hub portion 26 with respect to retaining ring 32 as the central shoulder portion 20 of the ceramic disk 12 changes dimension with temperature.

Figure 3:
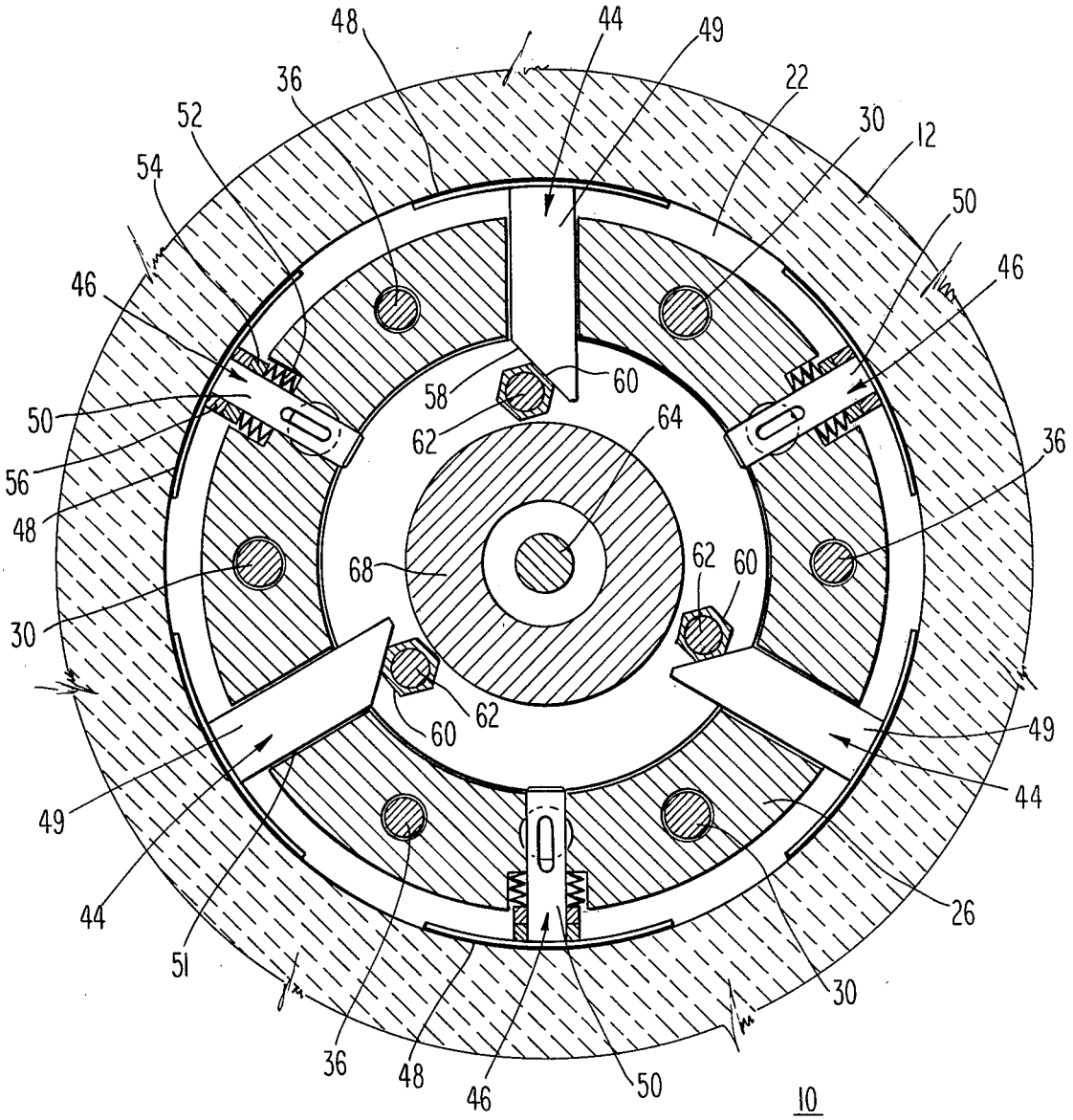
FIG. 3 is a cross-sectional view taken along lines 3—3 of FIG. 2.

As may best be seen in FIG. 3, and in accordance with an important aspect of the present invention, a plurality of radially movable shoes 44, 46 are situated in the bore 22 of the ceramic disk 12, which serve to fasten the first and second hub portions 24 and 26 respectively to the ceramic disk 12 thus forming the heat recovery wheel 10. The hub portions 24, 26 and ceramic disk 12 are mounted in a secure fashion which permits differential radial expansion of the hub portions with respect to the ceramic disk 12. The aforementioned shoes comprise a first set of at least three primary shoes 44 spaced equiangularly about the periphery of the bore 22. Also provided are at least three auxiliary shoes 46 situated equiangularly about the periphery of the bore 22. Both the primary shoes 44 as well as the secondary shoes 46 are radially movable with respect to the axis of the wheel 10.

Both the primary shoes 44 and also the axuiliary shoes 46 include a contact portion 48 which is designed to securely abut against the ceramic disk 12. Both the primary shoes 44 and the auxiliary shoes 46 further include stem portions 49 and 50 respectively which mate with channels 51 which are adapted to guide the shoes 44 and 46 such that they may move only in a radial direction. The auxiliary shoes 46 are biased radially against the ceramic disk 12 by means of belleville springs 52 which bear against spacers 52 and 56 and also against the second hub portion 26. Further details of the auxiliary shoes 46 are set forth in the aforementioned application of the present applicants, Ser. No. 205,780.

In accordance with the present invention, the aforementioned first set of primary shoes 44 are biased radially by a means for applying equal radial forces to each of the shoes 44 such that at all times and temperatures they are equally displaced from the central axis of the wheel 10. In this manner, the wheel 10 is always centered regardless of its temperature. The above mentioned means for applying equal forces to each of the shoes 44 includes a cam follower portion 58 which is a sloping face connected to and integral with the stem 50 of each of the primary shoes 44. The cam followers 58 are driven by cams 60 which, in the preferred embodiment, is a hex pivot. The cams 60 are rotatable about a plurality of pivot pins 62. As with reference to FIG. 2, and in accordance with an important aspect of the present invention, the cams 60 are driven in a circular path by a torsion bar 64. The torsion bar 64 is fixed with respect to the first hub portion 24 by being keyed to a torsion end cap 66. The torsion end cap 60 is secured to the first hub portion 24 by means of bolts 67. The torsion bar 64 is not in any way rigidly connected to the second hub portion 26, but is rigidly connected to a floating hub 68 which is rotatable with respect to the second hub portion 26. The floating hub 68 rotates within a central cavity of the second hub portion 26. The torsion bar 64 is fixed to the floating hub 68 by being keyed to a stationary end cap 70 which is fastened to the floating hub 68 by means of bolts 71. The aforementioned pivot pins 62 are situated in guideways 72 formed in the floating hub 68 such that the pivot pins are axially parallel with the axis of the torsion bar 64.

As the first hub portion 24 is rotated, a torque is applied to the torsion bar 64 through the torsion end cap 66. This torque is transmitted through the torsion bar 64 to the floating hub 68 through the stationary end cap 70. As the floating hub 68 rotates, the cams 60 are also caused to move in a circular path and bear against the sloping surfaces of cam followers 58 so as to radially bias the primary shoes 44 outwardly. In this manner, the rotational motion of the metal hub is converted to a radial force applied by the primary shoes 44. Since all of the primary shoes 44 are biased outwardly by a single torsion bar 64, and since they are equiangularly spaced about the periphery of the wheel 10, each of the shoes 44 will be equally displaced with respect to the center of the wheel. In this manner, the wheel 10 will always be self-centered as it rotates regardless of the temperature excursion to which the wheel has been subjected. Moreover, the aforementioned auxiliary shoes 46 are sufficiently biased radially outwardly by the springs 52 such that when the wheel 10 is not rotating the hub portions 24 and 26 are still securely fastened to the ceramic disk 12.

While a particular embodiment of the present invention has been shown and described, it will be appreciated that other modifications of the invention, not specifically mentioned, will occur to those skilled in the art and are intended to be included within the scope of the appended claims.

What is claimed is:

1. A mounting device for a heat recovery wheel of the type having a ceramic disk with a central bore therein comprising:

a first hub portion on one side of said wheel and axially aligned therewith;

at least three radially movable shoes situated in said bore, and coupled to said first hub portion, said shoes being equiangularly spaced about the periphery of said bore; and cam-driven means for applying equal radial forces to each of said shoes whereby said shoes are biased against said wheel at the periphery of said bore and equally displced from the axis of said wheel.

2. The mounting device of claim 1 wherein said cam-driven means comprises:

a torsion bar connected to said first hub portion;

at least three cams driven by said torsion bar; and cam followers connected to each of said shoes and driven by said cams.

3. The mounting device of claim 2 further comprising:

a floating hub rigidly attached to said torsion bar, said cams being attached to said floating hub.

4. The mounting device of claim 3 wherein said floating hub is rotatable about the axis of said first hub portion upon application of torque thereto through said torsion bar.

5. The mounting device of claim 4 further comprising a second hub portion on the opposite side of said wheel and axially aligned therewith, said first and said second hub portions being joined through said bore so as to clamp said wheel therebetween.

6. The mounting device of claim 5 wherein said second hub portion includes a central cavity and wherein said floating hub is rotatably mounted in said cavity.

7. The mounting of claim 6 further comprising a plurality of pivot pins equiangularly spaced about the axis of said floating hub, said cams being rotatably mounted to said pivot pins.

8. The mounting of claim 1 further comprising:

a plurality of auxiliary shoes spaced equiangularly about the periphery of said bore; and a spring means associated with each of said auxiliary shoes for biasing said auxiliary shoes radially outwardly against said wheel at the periphery of said bore.

9. The mounting of claim 5 further comprising fastening means for resiliently joining said first hub and said second hub to one another.

10. A rotatable recovery wheel comprising:

a round ceramic disk having a central bore therein;

a first hub portion on one side of said disk at said bore, said first hub being axially aligned with said disk;

at three radially movable shoes situated in and equiangularly spaced about said bore and coupled to said first hub potion; and cam-driven means for applying equal radial forces to said shoes whereby said shoes are biased against said disk and equally displaced from said axis upon rotation thereof.

11. The heat recovery wheel of claim 10 wherein said cam-driven means comprises:

a torsion bar connected to said first hub;

at least three cams driven by said torsion bar; and cam followers connected to each of said shoes and driven by said cams.

12. The heat recovery wheel of claim 1 further comprising:

a plurality of auxiliary shoes spaced equiangularly about said bore; and spring means associated with each of said shoes for biasing said auxiliary shoes radially outwardly against said wheel at the periphery of said bore.

* * * * *

UNITED STATES PATENT AND TRADEMARK OFFICE

CERTIFICATE OF CORRECTION

PATENT NO. : 4,330,029

DATED : May 18, 1982

INVENTOR(S) : Burton A. Noll - Richard P. Suhey

It is certified that error appears in the above-identified patent and that said Letters Patent are hereby corrected as shown below:

Column 2, line 7, "ajacent" to -- adjacent --.

Column 2, line 36, "Dec." to -- November --.

Column 6, line 30, line 1 of claim 12, the numerical "1" should be -- 11 --.

Signed and Sealed this

*Seventh* Day of *September 1982*

[SEAL]

*Attest:*

GERALD J. MOSSINGHOFF

*Attesting Officer* *Commissioner of Patents and Trademarks*